United States Patent [19]

Maeda

[11] 4,322,583

[45] Mar. 30, 1982

[54] VOICE COIL BOBBIN CONNECTION TO LOUDSPEAKER DIAPHRAGM OF HONEYCOMB CORE SANDWICHED BY SHEETS

[75] Inventor: Keijiro Maeda, Yokohama, Japan

[73] Assignee: Sony Corporation, Tokyo, Japan

[21] Appl. No.: 93,853

[22] Filed: Nov. 13, 1979

[30] Foreign Application Priority Data

Nov. 20, 1978 [JP] Japan ..... 53-143145

[51] Int. Cl.[3] ..... H04R 9/04

[52] U.S. Cl. ..... 179/115.5 VC

[58] Field of Search ..... 179/115.5 R, 115.5 VC, 179/181 R, 181 F; 181/170

[56] References Cited

U.S. PATENT DOCUMENTS 4,122,314 10/1978 Matsuda et al. ..... 181/170
4,232,204 11/1980 Roias ..... 179/115.5 R

FOREIGN PATENT DOCUMENTS 572766 6/1924 France ..... 179/115.5 R
23994 5/1931 Netherlands ..... 179/115.5 R
321430 11/1929 United Kingdom ..... 179/115.5 R
1526201 9/1978 United Kingdom ..... 179/115.5 R

*Primary Examiner*—George G. Stellar
*Attorney, Agent, or Firm*—Lewis H. Eslinger; Alvin Sinderbrand

[57] ABSTRACT

A diaphragm for a flat plate electroacoustic transducer such as a loudspeaker includes first and second diaphragm sheet members having a honeycombed core structure sandwiched therebetween and includes an interconnection between each diaphragm and the piston or voice coil bobbin to avoid shifts and delays in transmitting vibration to each diaphragm and eliminate the tendency to introduce extraneous auditory sounds.

3 Claims, 10 Drawing Figures

VOICE COIL BOBBIN CONNECTION TO LOUDSPEAKER DIAPHRAGM OF HONEYCOMB CORE SANDWICHED BY SHEETS

BACKGROUND OF THE INVENTION

1. Field of the Invention

The present invention relates generally to electroacoustic transducers such as loudspeakers and, more particularly, to flat plate loudspeakers having two parallel sheet diaphragm members sandwiched about an intermediate honeycombed core.

2. Description of the Prior Art

In conventional flat-plate loudspeakers a pair of diaphragms in the form of sheet members are sandwiched about a honeycomb core structure. The speaker drive piston or voice coil bobbin with a coil wound thereon is connected at one end to the rear sheet diaphragm member. Thus the voice coil bobbin imparts vibrations to the rear sheet diaphragm member. The vibrations imparted to the rear sheet diaphragm member are in turn imparted to the front sheet diaphragm member through the piston effect of the vibrating rear sheet diaphragm member acting against the air within the honeycomb core structure.

As is well known in loudspeakers of this general type, the honeycomb core structure has a high plane stiffness as a whole but the front and rear sheet diaphragm members do not. Therefore, in operation these conventional flat plate loudspeakers when driven by the voice coil bobbin bend the rear sheet diaphragm member slightly near the portion of the rear sheet member where the voice coil bobbin is connected.

Since this bend is very slight, it cannot be found in the frequency response or distortion response of the loudspeaker. However, the bending imparted to the rear sheet diaphragm member is of sufficient magnitude to introduce an extraneous and unwanted auditory sound and thus decreases the quality of the sound reproduced by the loudspeaker.

This deleterious effect is also compounded by the fact that there is a delay between the time vibration is imparted to the rear sheet diaphragm member by the voice coil bobbin and the corresponding vibration is imprarted to the front sheet diaphragm member due to the time it takes for the air within the honeycomb core to resonantly radiate to transmit vibration to the front sheet diaphragm member. The result is the transmission, due to bending of the rear sheet diaphragm member where it is connected to the voice coil bobbin, of an extraneous auditory sound, for example a booming sound.

However, it has been determined, according to the present invention, that this deleterious drawback of conventional flat plate loudspeakers can be eliminated by coupling the front sheet diaphragm member directly to the voice coil bobbin.

OBJECTS AND SUMMARY OF THE INVENTION

Accordingly, it is an object of the present invention to provide a flat plate diaphragm loudspeaker which avoids the above-noted disadvantages of conventional flat-plate loudspeakers.

Another object of the present invention is to provide a flat plate diaphragm speaker which is simple and economical to construct and which provides a better quality of reproduction in sound.

A still further object of the present invention is to provide a flat plate diaphragm speaker in which radiation and transmission of undesired extraneous auditory sounds is eliminated to a large extent.

In accordance with an aspect of the present invention, a flat plate speaker is provided having a pair of sheet diaphragm members sandwiched about a honeycomb core structure. The voice coil bobbin is directly coupled to both the front and rear sheet diaphragm members so that vibration is transmitted to both diaphragm members at the same time to eliminate delays and shifts in the transmission of vibrations and preclude the introduction of extraneous and undesired auditory sounds.

The above and other objects, features and advantages of the present invention will be more readily apparent from the following detailed description which is to be read in conjunction with the accompanying drawings.

DETAILED DESCRIPTION OF THE PREFERRED EMBODIMENTS

Figure 1:
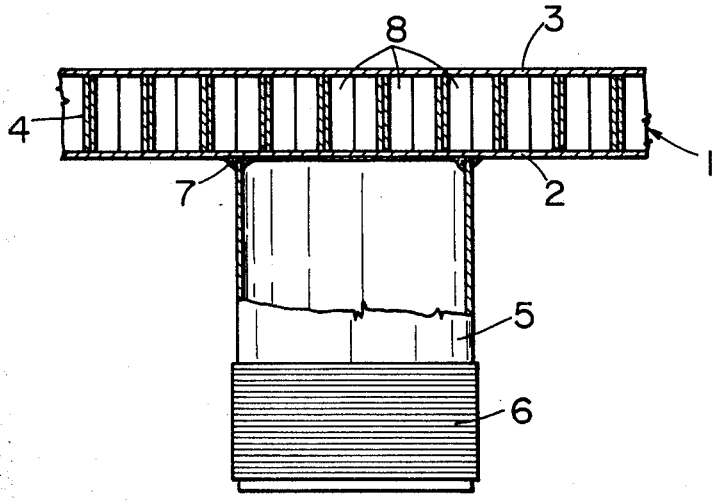
FIG. 1 PRIOR ART
FIG. 1 is a partial cross-sectional view of a conventional prior art flat plate diaphragm speaker.

Referring to the drawings, and initially to FIG. 1, there is shown a conventional flat plate loudspeaker 1 which includes rear and forward diaphragm sheet members 2 and 3, respectively, and a core member 4 sandwiched between sheet members 2 and 3 and secured thereto by any suitable means, such as an adhesive. Core member 4 may be made from any structurally sufficient and lightweight material, such as, a honeycomb box-like structure, preferably of aluminum sheet material. The sheet members 2 and 3 are preferably of sheet aluminum or carbon fiber material and are secured to opposite sides of core member 4 and are substantially co-extensive with the core member. Typically, at least one magnetic driver, such as a voice coil bobbin 5, about which is wound a coil 6, is secured to the rear diaphragm sheet member 2 about the peripheral surface 7 of the voice coil bobbin 5. When the conventional flat plate loudspeaker 1 is driven, voice coil bobbin 5 excites and vibrates the rear sheet diaphragm member 2 creating a piston effect to resonate the air within the honeycomb core in passages 8 to correspondingly vibrate the forward diaphragm sheet member 3. The conventional flat plate loudspeaker as shown in FIG. 1 suffers from the disadvantage enumerated above.

Figure 2:
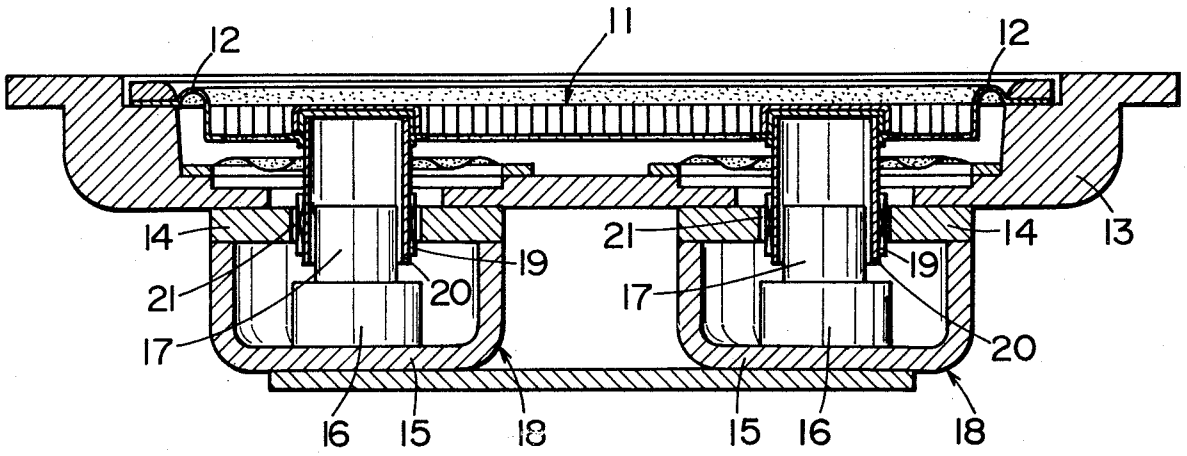
FIG. 2 is a cross-sectional view of a flat plate diaphragm loudspeaker according to one embodiment of the present invention having its diaphragm driven at a plurality of vibration nodes.

Referring now to FIG. 2, there is shown a flat plate loudspeaker according to one embodiment of the present invention having a diaphragm assembly driven at a plurality of vibration nodes, for example at four vibration nodes by four magnetic driving elements. In this embodiment of the present invention a square shaped flat plate diaphragm assembly 11 including forward and rearward diaphragm sheet members sandwiched about a honeycomb structure is attached at its peripheral edges to the front side of a square support frame 13 by a resilient retaining member 12. The diaphragm assembly 11 is driven by four magnetic circuits 18 comprising a plate member 14, a yoke 15, a permanent magnet 16 and a center pole 17 all attached to the rear side of square frame 13 at four spaced locations. Each of the magnetic circuits 18 include a voice coil 19 wound on the periphery of a voice coil bobbin 20. In addition, a ring-shaped magnetic gap 21 is formed between the center pole 17 and plate 14 in magnetic circuit 18 and the voice coil bobbins 20 are each arranged in a respective magnetic gap 21 at the rear portions thereof. The forward end of each voice coil bobbin 20 is connected to the diaphragm assembly 11 to both the front and rear sheet diaphragm members, as will be explained more fully hereinbelow. With this type of assembly the driving force of each voice coil simultaneously drives each magnetic circuit 18 to simultaneously drive the diaphragm assembly 11 simultaneously at the four node portions.

Figure 3:
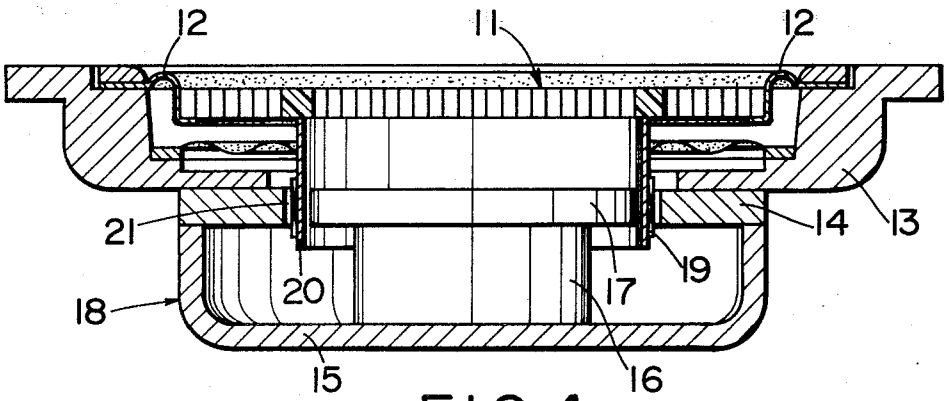
FIG. 3 is a cross-sectional view of a flat plate diaphragm loudspeaker according to another embodiment of the present invention wherein the diaphragm is driven at one vibration node.

Reference is now made to FIG. 3 where there is shown a flat plate loudspeaker having a diaphragm assembly driven at one vibration node by one magnetic driver having a single voice coil. This embodiment of the present invention is similar to the embodiment shown in FIG. 2 the only difference being that one magnetic driver assembly is utilized instead of the plurality of magnetic driving circuits illustrated in FIG. 2.

Referring now to FIGS. 4 through 8, these drawing figures illustrate the manner of interconnecting the front and rear diaphragm sheet members to a voice coil bobbin and it is to be understand that each of the embodiments illustrated in FIGS. 4 through 8 may be used with the multiple magnetic driving circuit embodiment of FIG. 2 or the single magnetic driving circuit embodiment of FIG. 3.

Figure 4:
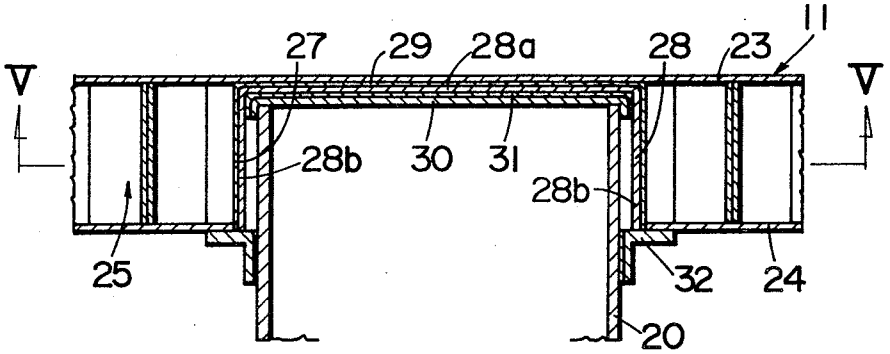
FIG. 4 is a partial cross-sectional view, on a somewhat enlarged scale, showing a detail of a first embodiment of the connection of the voice coil bobbin to the loudspeaker diaphragm.
Figure 5:
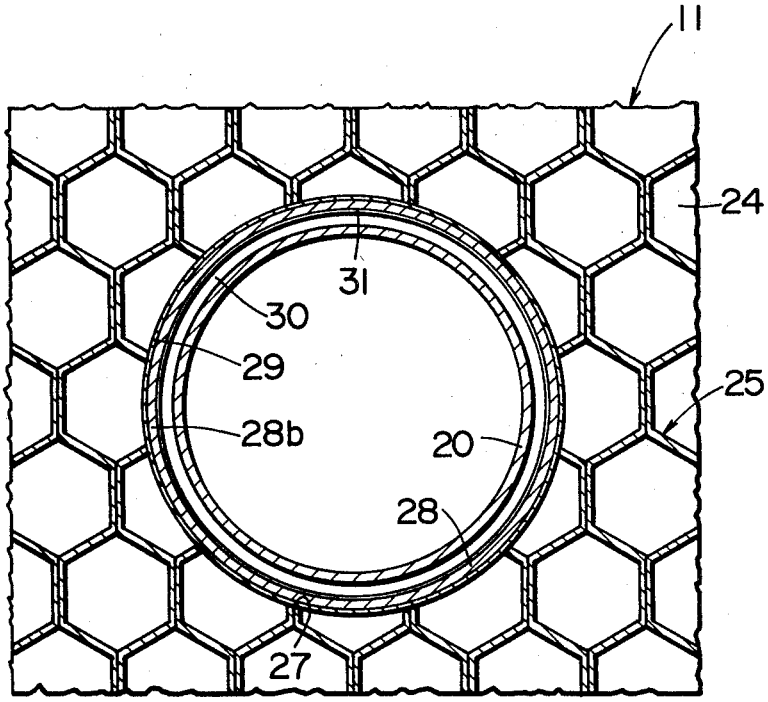
FIG. 5 is a cross-sectional view taken along line V—V of FIG. 4.

Referring first to FIGS. 4 and 5, a first embodiment of the flat plate loudspeaker according to the present invention is shown wherein the diaphragm assembly 11 includes a forward diaphragm sheet member 23, a rear diaphragm sheet member 24 of sheet aluminum or carbon fiber respectively secured to opposite sides of a honeycomb core structure 25 made of any structurally sufficient and lightweight material.

In this embodiment of the present invention, at the connection portion of the voice coil bobbin 20 of the diaphragm assembly 11, a segment of the rear diaphragm sheet member 24 and of the honeycomb core structure 25 corresponding to the circular area defined by the voice coil bobbin 20 is removed to form a cavity 27 therein. The forward diaphragm sheet member 23 is not disturbed and remains as a solid sheet member.

Voice coil bobbin 20 is disposed within cavity 27 in diaphragm assembly 11 and a cup-shaped supporting member 28, which may be made of aluminum foil or plastic material, is disposed over the end of voice coil bobbin 20 within cavity 27 to reinforce the diaphragm assembly 11. Supporting member 28 is fixed within cavity 27 in any suitable manner, for example by adhesive agent 29 to adhere the end portion **28*a* of the supporting member 28 to the undersurface of the front diaphragm sheet member 23 and to adhere the tubular portion 28*b* of supporting member 28 to contiguous parts of the core structure 25**.

A bobbin cap 30 is fixed to the forward end of the voice coil bobbin 20 and is adhered to the inside surface of end portion **28*a* of supporting member 28 by a suitable adhesive agent 31. Alternatively, instead of using a bobbin cap 30, the free end of voice coil bobbin 20 may be directly adhered to the inside surface of end portion 28*a* of the supporting member 28 also by a suitable adhesive agent. Alternatively, the exterior surface of bobbin 20 may be adhered directly to contiguous surfaces of the core structure 25 if desired. It is also to be understood that in order to keep the diaphragm as light in weight as possible, suitable openings can be formed in the bottom end portion 28*a*** of the supporting member.

As seen in FIG. 4, an exterior ring-shaped supporting member 32 may be also fixed by suitable adhesive agents between the outside peripheral surface of the voice coil bobbin and the exterior surface of the rear diaphragm sheet member 24.

It is thus apparent that in this embodiment of the present invention, the voice coil bobbin 20 is directly connected to the forward diaphragm sheet member 23 of diaphragm assembly 11 through the supporting member 28 so that the front diaphragm sheet member 23 is directly driven by the voice coil bobbin 20. At the same time, voice coil bobbin 20 also drives the rear diaphragm sheet member 24 so that both diaphragm sheet members in diaphragm assembly 11 are simultaneously driven by voice coil bobbin 20. With such a construction, deleterious effects from the slight bending imparted to the rear diaphragm sheet member and the delay in transmitting vibrations from the rear diaphragm member to the forward diaphragm member which are inherent in conventional prior art flat plate loudspeakers as shown in FIG. 1 are effectively eliminated.

Figure 6:
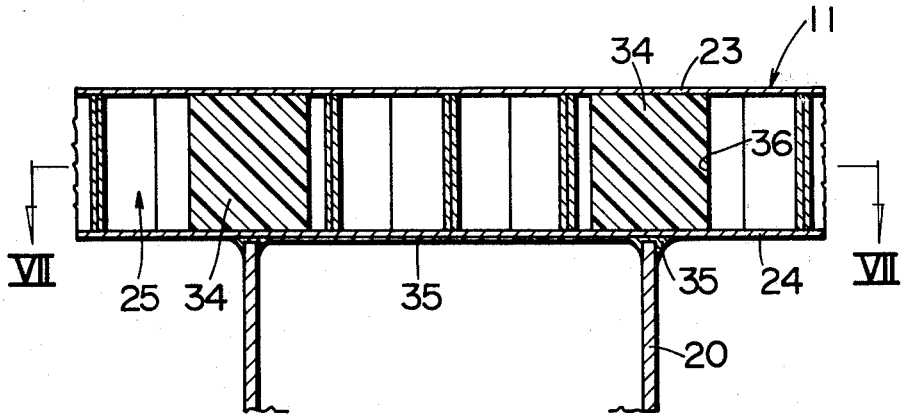
FIG. 6 is a partial cross-sectional view similar to FIG. 4 showing another embodiment of the connection of the voice coil bobbin to the loudspeaker diaphragm.
Figure 7:
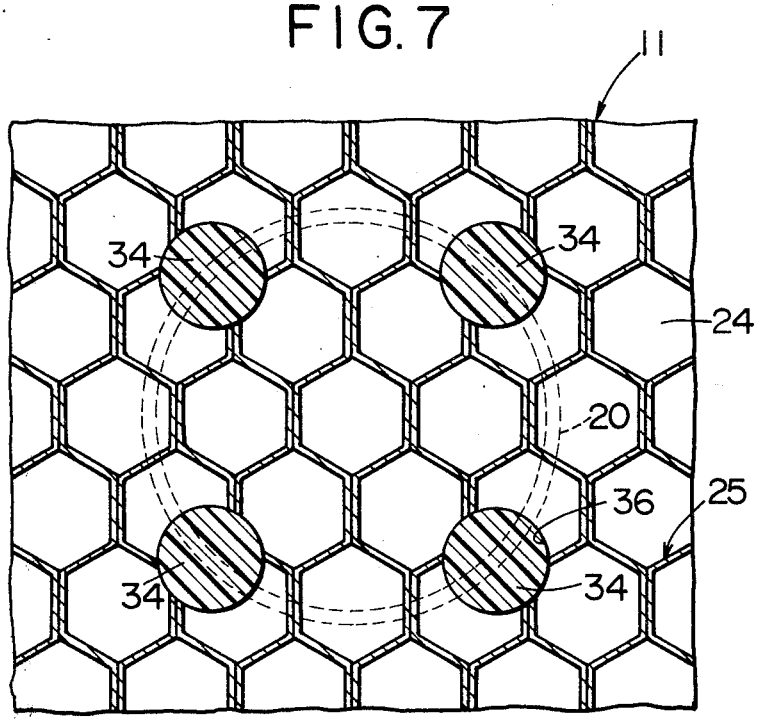
FIG. 7 is a cross-sectional view taken along line VII—VII of FIG. 6.

Reference is now made to FIGS. 6 and 7 where a second embodiment of the interconnection between the front and rear sheet diaphragm members is illustrated. In this embodiment, like reference numerals are used to designate elements which are the same as in the embodiment of FIG. 4. In the embodiment shown in FIGS. 6 and 7, the voice coil bobbin 20 is secured to the rear diaphragm sheet member 24 at its peripheral edge surface, in any convenient manner, for example by a voice coil bobbin cap 35 fixed to the open end of voice coil bobbin 20 and adhered to the exterior surface of the rear sheet diaphragm member 24 by a suitable adhesive.

Voice coil bobbin 20 is directly coupled to the front diaphragm sheet member 23 through a plurality of circumferentially spaced pillars 34 disposed within suitable access openings 36 formed within the core structure 25. Pillars 34, which may be solid, tubular, or hexagonal in shape to correspond to the shape of the through passages in core structure 25, are preferably made of aluminum or lightweight synthetic resin material. When assembling the diaphragm assembly 11 the pillars 34 are arranged and disposed within the core structure 25 in a circumferential array at predetermined spaced intervals and the front and rear diaphragm sheet members 23 and 24 are adhered to opposite ends of pillars 34 in any convenient manner, for example, by a suitable adhesive agent.

Voice coil bobbin 20, as described above, is adhered to the outside surface of the rear diaphragm sheet member 24 and, vibrations imparted to the diaphragm assembly 11 by voice coil bobbin 20 are, therefore, directly imparted to each diaphragm sheet member 23 and 24 simultaneously.

Figure 8:
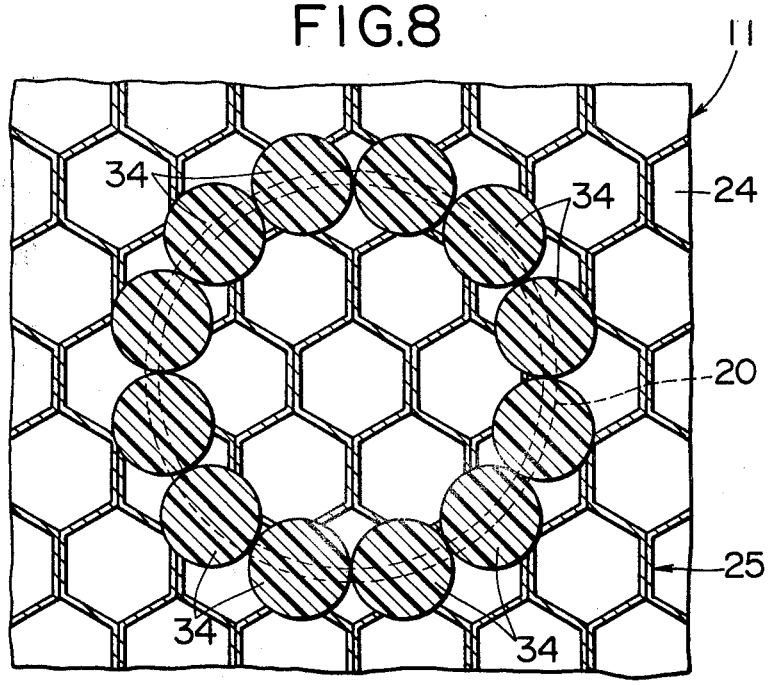
FIGS. 8, 9 and 10 are cross-sectional views similar to FIGS. 5 and 7 showing still other embodiments of the present invention.
Figure 9:
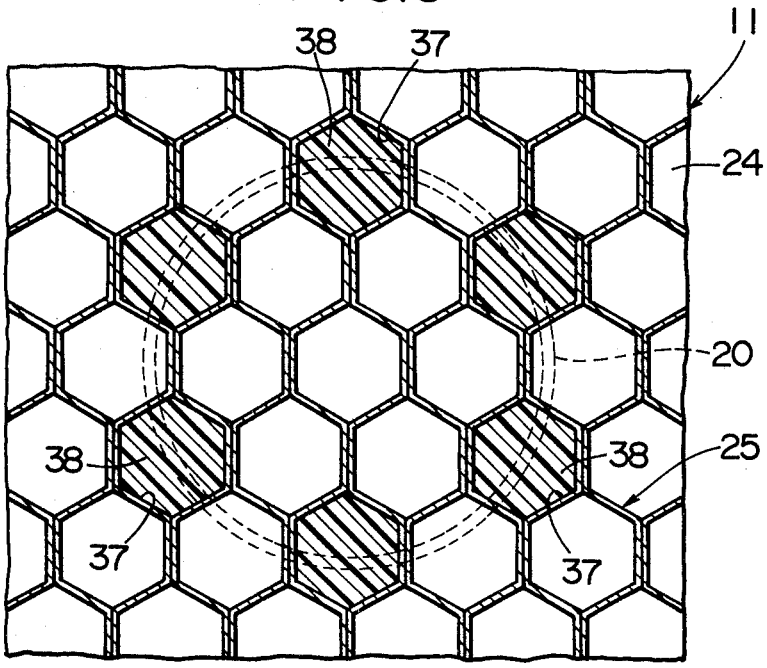
Figure 10:
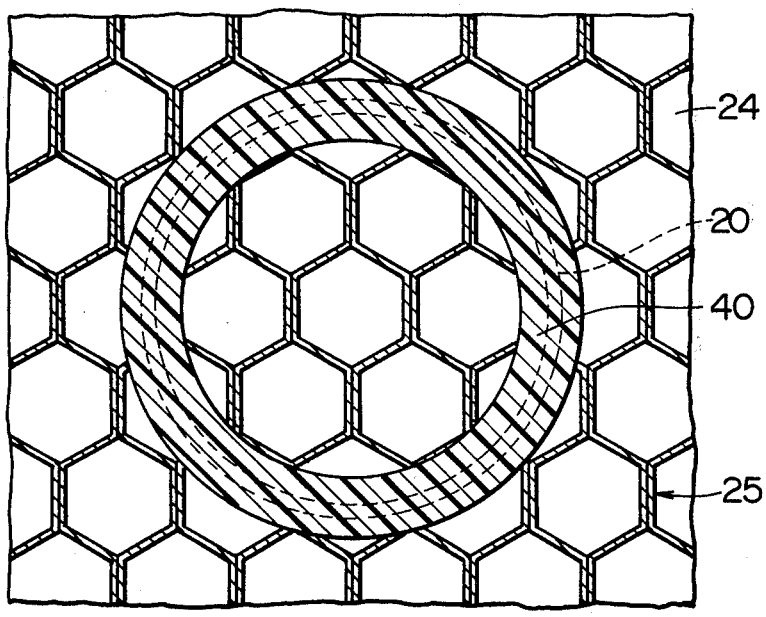

Referring now to FIGS. 8 through 10 additional embodiments relating to the interconnection of the front and rear diaphragm sheet members 23 and 24 with the voice coil bobbin 20 are illustrated. In the embodiment shown in FIG. 8, this embodiment is similar to the embodiment shown in FIG. 7, the only difference being that in this embodiment of the invention a greater number of the interconnecting support pillars 34 are utilized disposed in tightly packed circular array to provide a greater extent of interconnection between voice coil bobbin 20 and the pair of diaphragm sheet members 23 and 24.

Referring to FIG. 9, this additional embodiment of the loudspeaker according to the present invention is constructed by inserting a hardenable filling material 38 within selected ones of the hexagonally shaped through openings 37 of the honeycombed core structure 25. The filling material 38 is preferably selected from a synthetic resin material, for example, epoxy resin or any other suitable material which may be hardened. In this embodiment, selected ones of the hexagonally shaped openings 37 in circular array and in contiguous relationship to the end of voice coil bobbin 20 are filled with the filler material during the assembly of the diaphragm assembly 11. As in the other embodiments, the diaphragm sheet members 23 and 24 are suitably adhesively attached to each end of the filled piller 38.

Referring now to FIG. 10 where still another embodiment of the loudspeaker according to the present invention is disclosed, in this embodiment a tubular supporting member 40, preferably made of aluminum or a suitable synthetic resin is used. The tubular supporting member 40 is disposed within the core structure 25 and is oriented so as to have a confronting edge surface in alignment with the end of voice coil bobbin 20. As in the other embodiments described herein, the voice coil bobbin 20 is adhered to the rear surface of the rear diaphragm sheet member 24 and the diaphragm sheet members 23 and 24 are fixed to the supporting member 40 by a suitable adhesive agent.

It is thus seen that each of the various embodiments of the loudspeaker of the present invention described herein provide a flat plate loudspeaker assembly wherein a pair of diaphragm sheet members are disposed in sandwich relationship about a honeycomb core structure. Each of the embodiments provides a unique structural interaction between the voice coil bobbin and both diaphragm sheet members so that vibration of the diaphragm of the loudspeaker by the voice coil bobbin is imparted to both the forward and rearward diaphragm sheet members simultaneously. With this construction, when the loudspeaker is driven extraneous and undesired auditory sounds due to the bending of the rear diaphragm sheet member are eliminated and the slight delay between excitation of the rear diaphragm member and the forward diaphragm member is also eliminated. Thus a loudspeaker according to the present invention reproduces sound in a high quality and, since the characteristics of a diaphragm of a honeycomb structure remains essentially the same as in prior art conventional flat plate loudspeakers of this type, the vibration efficiency of the diaphragm and the frequency response of the radiation of sound expected from such a flat plate type loudspeaker remain.

The foregoing description describes specific preferred embodiments of the invention with reference to the accompanying drawings. However, it is to be understood that the invention is not limited to those precise embodiments, and that various changes and modifications may be effected therein by one skilled in the art without departing from the scope or spirit of the invention as defined in the appended claims.

What is claimed is:

1. A flat plate loudspeaker comprising, a diaphragm assembly including first and second diaphragm sheet members spaced from each other by a honeycomb like core structure, a magnetic driving circuit including a voice coil bobbin member operatively associated with said diaphragm assembly to impart vibration thereto, means disposed within said core structure cooperatively interlocking said voice coil bobbin member with each of said first and second diaphragm sheet members whereby each said first and second diaphragm sheet members are driven simultaneously by said voice coil bobbin member when said magnetic driving circuit is driven, said means cooperatively interlocking said voice coil bobbin with each of said first and second diaphragm sheet members comprising a cavity formed within said core structure and an opening formed within said second diaphragm sheet member within which an end of said voice coil bobbin member is disposed, said voice coil bobbin member being secured to a peripheral surface of said second diaphragm sheet member adjacent said opening therein and secured to said first diaphragm sheet member at an interior facing surface thereof within the cavity formed within said core structure, and an end cap member disposed on the free end of said voice coil member, said end cap member being secured to said voice coil member and to the interior facing surface of said first diaphragm sheet member.

2. The loudspeaker according to claim 1 wherein said end cap member is secured to contiguous surfaces of said core structure within said cavity.

3. A flat plate loudspeaker comprising, a diaphragm assembly including first and second diaphragm sheet members spaced from each other by a honeycomb like core structure, a magnetic driving circuit including a voice coil bobbin member operatively associated with said diaphragm assembly to impart vibration thereto, means disposed within said core structure cooperatively interlocking said voice coil bobbin member with each of said first and second diaphragm sheet members whereby each said first and second diaphragm sheet members are driven simultaneously by said voice coil bobbin when said magnetic driving circuit is driven, said means cooperatively interlocking said voice coil bobbin with each of said first and second diaphragm sheet members comprising a cavity formed within said core structure and an opening formed within said second diaphragm sheet member within which an end of said voice coil bobbin member is disposed, said voice coil bobbin member being secured to a peripheral surface of said second diaphragm sheet member adjacent said opening therein and secured to said first diaphragm sheet member at an interior facing surface thereof within the cavity formed within said core structure, and said voice coil bobbin member being secured to the outside facing surface of said second diaphragm sheet member by a ring member secured to said voice coil bobbin member and said second diaphragm sheet member around the peripheral extend of said second diaphragm sheet member adjacent said opening therein.

* * * * *